US010754287B2

(12) United States Patent
Horiguchi et al.

(10) Patent No.: US 10,754,287 B2
(45) Date of Patent: Aug. 25, 2020

(54) IMAGE POST-PROCESSING METHOD, IMAGE POST-PROCESSING APPARATUS AND IMAGE FORMING APPARATUS

(71) Applicant: Konica Minolta, Inc., Tokyo (JP)

(72) Inventors: Haruo Horiguchi, Koganei (JP); Seijiro Takahashi, Kokubunji (JP); Toyoko Shibata, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/185,939

(22) Filed: Nov. 9, 2018

(65) Prior Publication Data

US 2019/0171155 A1 Jun. 6, 2019

(30) Foreign Application Priority Data

Dec. 4, 2017 (JP) ..... 2017-232239

(51) Int. Cl.

| | |
|---|---|
| ***G03G 15/00*** | (2006.01) |
| ***G03G 15/20*** | (2006.01) |
| ***G03G 15/22*** | (2006.01) |
| ***G03G 13/20*** | (2006.01) |

(52) U.S. Cl.

CPC ..... *G03G 15/6585* (2013.01); *G03G 13/20* (2013.01); *G03G 15/2021* (2013.01); *G03G 15/22* (2013.01); *G03G 2215/0081* (2013.01); *G03G 2215/00426* (2013.01); *G03G 2215/00805* (2013.01)

(58) Field of Classification Search

CPC .... G03G 15/6585; G03G 13/20; G03G 15/22; G03G 15/2021; G03G 2215/0081; G03G 2215/00426; G03G 2215/00805

See application file for complete search history.

(56) References Cited

U.S. PATENT DOCUMENTS

| | | | | |
|---|---|---|---|---|
| 7,672,634 | B2 * | 3/2010 | Lofthus | G03G 15/2003 399/341 |
| 10,663,902 | B2 * | 5/2020 | Horiguchi | G03G 15/6585 |
| 2002/0094220 | A1 | 7/2002 | Bartscher et al. | |
| 2012/0251935 | A1 * | 10/2012 | Ishihara | G03G 9/0821 430/105 |

(Continued)

FOREIGN PATENT DOCUMENTS

| | | | |
|---|---|---|---|
| JP | 2007072022 | A | 3/2007 |
| JP | 2009058730 | A | 3/2009 |
| JP | 2014123033 | A | 7/2014 |

OTHER PUBLICATIONS

EPO, Extended European Search Report for the corresponding European Patent Application No. 18210223.6, dated Aug. 19, 2019 (8 pages).

*Primary Examiner* — Walter L Lindsay, Jr.
*Assistant Examiner* — Laura Roth
(74) *Attorney, Agent, or Firm* — Lucas & Mercanti, LLP

(57) ABSTRACT

An image post-processing method includes a glossiness control step of irradiating a fixed toner image with a glossiness control light. The toner image is formed with a toner containing a compound that absorbs light. The glossiness control light is capable of at least reducing a glossiness of the fixed toner image. The glossiness control light has a maximum emission wavelength in a wavelength region which is absorbed by the compound.

13 Claims, 4 Drawing Sheets

(56) References Cited

U.S. PATENT DOCUMENTS

| | | | | |
|---|---|---|---|---|
| 2013/0186558 | A1* | 7/2013 | Comb | G03G 15/2021 156/277 |
| 2013/0243503 | A1* | 9/2013 | Hirayama | G03G 15/2021 399/341 |
| 2014/0002572 | A1* | 1/2014 | Liu | B41J 2/435 347/246 |
| 2014/0063158 | A1 | 3/2014 | Liu | |
| 2019/0187606 | A1* | 6/2019 | Horiguchi | G03G 15/2021 |

* cited by examiner

IMAGE POST-PROCESSING METHOD, IMAGE POST-PROCESSING APPARATUS AND IMAGE FORMING APPARATUS

Japanese Patent Application No. 2017-232239, filed on Dec. 4, 2017 with Japan Patent Office, is incorporated herein by reference in its entirety.

TECHNICAL FIELD

The present invention relates to an image post-processing method, an image post-processing apparatus, and an image forming apparatus. More specifically, the present invention relates to an image post-processing method, an image post-processing apparatus, and an image forming apparatus capable of adjusting the glossiness of a toner image without affecting the fixability of the toner image.

BACKGROUND

In recent years, the types of recording media on which images are formed are diversified. The quality of gloss (glossiness) differs between wood free paper and coated paper, for example, since the surface shape is different. In addition, when a toner image is formed on a recording medium, the difference between the glossiness of the portion where the image is formed (image portion) and the glossiness of the background portion (non-image portion) of the recording medium on which the image is not formed is large, the user may feel uncomfortable.

In view of this, in order to control the glossiness of the toner image, a fixing device which switches the selection between the case of giving gloss to the image and the case of not giving gloss to the image by changing the fixing temperature of the image is known (refer to, for example, Patent document 1: JP-A 2007-72022).

SUMMARY

The present invention was done based on the above-described problems and situations. An object of the present invention is to provide an image post-processing method, an image post-processing apparatus, and an image forming apparatus capable of adjusting the glossiness of a toner image without affecting the fixability of the toner image.

In order to solve the above-mentioned problem, the present inventors examined the causes of the above problems. As a result, the present inventors found a method for making a toner image to have a desired glossiness and the present invention has been achieved.

An aspect of the image post-processing method of the present invention contains a glossiness control step of reducing or increasing the glossiness of a fixed toner image. This image post-processing method is a method for controlling a glossiness of a fixed toner image. The method contains the glossiness control step of: irradiating the fixed image formed with a toner containing a compound that absorbs light and fixed on a recording medium with a glossiness control light that is capable of at least reducing a glossiness of the fixed toner image, wherein the glossiness control light has a maximum emission wavelength in a wavelength region which is absorbed by the compound. It was found that the toner image can be made to have a required glossiness by this image post-processing method containing a glossiness control step.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
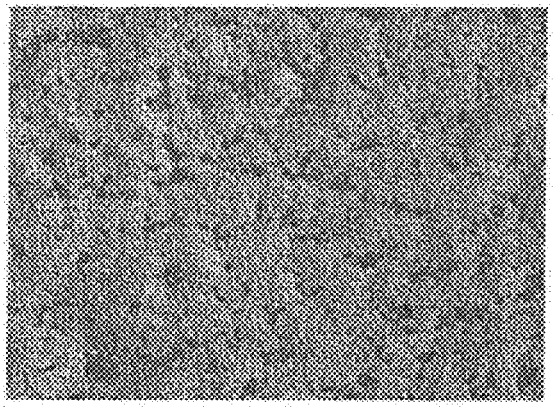
FIG. 1 is an observation diagram illustrating the surface of the toner image before irradiation with a glossiness control light.

Hereinafter, one or more embodiments of the present invention will be described with reference to the drawings. However, the scope of the invention is not limited to the disclosed embodiments.

The image post-processing method of the present invention is a method of for controlling a glossiness of a fixed toner image. This method is characterized in having a glossiness control step of reducing or increasing the glossiness of the fixed toner image. The image post-processing method contains the step of: irradiating the fixed toner image formed with a toner containing a compound that absorbs light and fixed on a recording medium with a glossiness control light that is capable of reducing a glossiness of the fixed toner image, wherein the glossiness control light has a maximum emission wavelength in a wavelength region which is absorbed by the compound. This feature is a technical feature common or corresponding to the following embodiments.

The present invention makes it possible to provide an image post-processing method, an image post-processing apparatus, and an image forming apparatus capable of adjusting the glossiness of a toner image without affecting the fixability of the toner image.

An expression mechanism or an action mechanism of the effects of the present invention is as follows. When a certain compound is irradiated with light in the wavelength range absorbed by the compound, the compound Transits from the ground state to the excited state, and when returning to the ground state due to nonradiative deactivation, the compound releases thermal energy equivalent to the absorbed light energy. When light in the wavelength range absorbed by the compound is irradiated to a toner containing such a compound (for example, colorant and ultraviolet absorber), the effect of softening and dissolving the resin around the compound due to the released thermal energy is obtained.

The present inventors have found that the glossiness can be controlled by re-softening and remelting the toner by irradiating the fixed toner image with light and changing the surface state of the toner image.

Specifically, for example, when irradiating light with a light amount which softens the toner but does not remelt, the fixed toner is elastically recovered and the irregularity of the image surface is increased, so that it is possible to reduce the degree of glossiness.

On the other hand, when irradiating light with a light amount higher than that, the toner is remelted, the entire image is smoothed, and the glossiness may be increased compared to before light irradiation.

In this manner, the glossiness of the toner image may be controlled by reducing or increasing the glossiness by the light irradiated to the toner image.

In the image post-processing method of the present invention, the glossiness is not controlled by changing the fixing temperature of the image as in Patent document 1, but by simply irradiating the predetermined glossiness control light. It is possible to control the glossiness of the toner image by this.

Therefore, in the image post-processing method of the present invention, it is possible to control glossiness of the toner image without affecting the fixability of the toner image.

In an embodiment of the present invention, in the glossiness control step, it is preferable to adjust the light amount of the glossiness control light based on the glossiness information designated by the user. With this, it is possible to irradiate the toner image with the glossiness control light with the light amount having the glossiness designated by the user.

In an embodiment of the present invention, control of the light amount of the glossiness control light is preferably performed based on the relational information on the change in the glossiness of the toner image with respect to the light amount of the glossiness control light to be irradiated. Thereby, it is possible to more precisely adjust the amount of light which achieves the glossiness designated by the user.

In an embodiment of the present invention, in the glossiness control step, it is preferable to set the irradiation position of the glossiness control light based on the positional information of the toner image designated by the user. Thereby, it is possible to reduce or increase the glossiness of only a specific portion of the toner image.

In an embodiment of the present invention, in the glossiness control step, it is preferable to irradiate the glossiness control light to the toner image fixed on the plurality of portions on the recording medium. Thereby, it is possible to reduce of increase the glossiness of each of the plurality of toner images fixed at positions apart from each other on the recording medium.

In an embodiment of the present invention, it is preferable that the glossiness control light has a maximum emission wavelength in a wavelength region of 280 nm to 850 nm.

In order to reduce or increase the glossiness of the toner image, it is necessary to efficiently remelt the toner.

Therefore, a compound that absorbs light in a wavelength range of 280 nm to 850 nm having large excitation energy is incorporated in the toner, and by irradiating light having the maximum emission wavelength in a wavelength region absorbed by the compound (e.g., colorant and UV absorber) to the compound, it becomes easy to control the glossiness of the toner image.

In an embodiment of the present invention, it is preferable that the glossiness control light has a maximum emission wavelength in a wavelength region of 280 nm to 500 nm. When the maximum emission wavelength is hi this wavelength range, sufficient energy for changing the glossiness may be obtained by the glossiness control light. Therefore, it is unnecessary to change the light source depending on the type of the colorant used for the toner, and the space for the image post-processing apparatus may be saved.

As an embodiment of the present invention, from the viewpoint of effectively obtaining the effect of present invention, it is preferable to use a colorant as the above-described compound.

As an embodiment of the present invention, from the viewpoint of effectively obtaining the effect of the present invention, it is preferable to use a UV absorber as the above-described compound.

In an embodiment of the present invention, it is preferable to have a step of detecting the glossiness of the toner image fixed on the recording medium before the glossiness control step. As a result, it becomes possible to more precisely adjust the glossiness.

An image post-processing apparatus of the present invention is characterized in containing a glossiness control unit to reduce or increase a glossiness of the fixed toner image by irradiating the fixed toner image formed with a toner containing a compound that absorbs light and fixed on a recording medium with a glossiness control light that is capable of reducing a glossiness of the fixed toner image.

An image forming apparatus of the present invention is characterized in containing: a transfer unit to transfer a toner image formed in a developing unit with a toner containing a compound that absorbs light on a recording medium; a fixing unit to fix the transferred toner image on the recording medium; and a glossiness control unit to reduce or increase a glossiness of the fixed toner image by irradiating the fixed toner image formed on the recording medium with a glossiness control light having a maximum emission wavelength in a wavelength region which is absorbed by the compound and is capable of reducing the glossiness of the fixed toner image.

Another image forming apparatus of the present invention is characterized in containing: a transfer unit to transfer a toner image formed in a developing unit with a toner containing a compound that absorbs light on a recording medium; and a fixing unit to fix the transferred toner image on the recording medium, wherein the image forming apparatus is connected to the above-described image post-processing apparatus.

The present invention and the constitution elements thereof, as well as configurations and embodiments, will be detailed in the following. In the present description, when two figures are used to indicate a range of value before and after "to", these figures are included in the range as a lowest limit value and an upper limit value.

[Image Post-Processing Method]

The image post-processing method of the present invention is a method for controlling a glossiness of a fixed toner image. This method is an image post-processing method having a glossiness control step of reducing or increasing the glossiness of the fixed toner image. The image post-processing method contains the step of: irradiating the fixed toner image formed with a toner containing a compound that absorbs light and fixed on a recording medium with a glossiness control light that is capable of at least reducing a glossiness of the fixed toner image, wherein the glossiness control light has a maximum emission wavelength in a wavelength region which is absorbed by the compound.

The step of fixing the toner image on the recording medium according to the present invention is carried out to the toner image transferred onto the recording medium, through a charging step, an exposing step, a developing step and a transferring step which are well-known electrophotographic image forming methods.

Hereinafter, these steps and the cleaning step performed after these steps will be described, and the glossiness control step according to the present invention will be described.

<Charging Step>

In this step, the electrophotographic photoreceptor is charged. The method of charging may be, but not limited to, a contact or contactless roller charging type.

<Exposing Step>

In this step, an electrostatic latent image is formed on the electrophotographic photoreceptor (an electrostatic latent image carrying member).

The electrophotographic photoreceptor may be, but not limited to, a drum shape photoreceptor made of a known organic photoreceptor, for example.

Formation of the electrostatic latent image is performed by, as described below, charging the surface of the electrophotographic photoreceptor uniformly with a charger and by imagewise exposing the surface of the electrophotographic photoreceptor with an exposing means.

The exposing means is not particularly limited and may include LEDs composed of light emitting elements arrayed in the axial direction of the electrophotographic photoreceptor 1Y and imaging elements or may be a laser optical system.

<Developing Step>

In the developing step, a toner image is formed by developing the electrostatic latent image is using a dry type developer including a toner.

Formation of the toner image using a dry type developer including the toner can be performed, for example, with a developing sleeve incorporating a magnet and rotating with the developer retained and a voltage applying device applying a direct current and/or alternating current bias voltage between the developing sleeve and the photoreceptor. More specifically, the toner and the carrier are mixed and stirred so that the toner charged by their friction is retained on the surface of the rotating magnet roller to form a magnetic brush. Since the magnetic roller is disposed at a neighborhood of the electrophotographic photoreceptor, a part of the toner that constitutes the magnetic brush formed on the surface of the magnetic roller is transferred by an electrical attraction force to the surface of the electrophotographic photoreceptor. As a result, the electrostatic latent image is developed with the toner and the toner image is formed on the surface of the electrophotographic photoreceptor.

<Transferring Step>

In this step, the toner image is transferred on the recording medium.

The transfer of the toner image on the recording medium is performed by peel charging of the toner image on the recording medium.

As a transferring means, for example, a corona transferring device with corona discharge, a transfer belt, or a transfer roller can be used.

The transferring step may be performed, for example, using an intermediate transferring member, by first transfer of the toner image is on the intermediate transferring member, then by second transfer of the toner image on the recording medium. Alternatively, the toner image formed on the electrophotographic photoreceptor is directly transferred to the recording medium.

Examples of the recording medium include, but are not particularly limited to, normal paper from thin paper to thick paper, high-quality paper, coated printing paper such as art paper and coated paper, commercially available Japanese paper and postcard paper, plastic film for OHP, and cloth.

<Fixing Step>

In this step, the toner image transferred on the recording medium is fixed on the recording medium. Specifically, for example, a fixing roller and a pressure roller are pressed against each other so that a fixing nip portion is formed at the fixing roller in this step.

In such cases, the fixing roller may be used as a heating means. The toner image melted by light irradiation is further softened by heating so that the fixing property onto the recording medium can be improved. The temperature of the fixing roller is preferably within the range of 30 to 100° C., more preferably within the range of 40 to 100° C.

<Cleaning Step>

In this step, a liquid developer which has not been used to form images or which remains without being transferred is removed from developer carrying member such as a developing roller, the photoreceptor, and intermediate transferring member.

The cleaning method is not particularly limited, but it is preferable to use a method which uses a blade having a tip disposed in contact with the photoreceptor, and scratching the surface of the photoreceptor. For example, in this step, a cleaning blade and a brush roller disposed at an upstream side of the cleaning blade can be used.

<Glossiness Control Step>

In the fixing step according to the present invention, a toner image formed using a toner containing a compound that absorbs light is fixed on a recording medium. In the glossiness control step, a toner image fixed on a recording medium is irradiated with glossiness control light having a maximum emission wavelength within a wavelength region in which the compound absorbs light and capable of at least reducing the glossiness of the toner image. Thereby, the glossiness of the image is reduced or increased.

Specifically, in the glossiness control step, for example, when irradiating light with a light amount which softens the toner but does not remelt, the fixed toner is elastically recovered and the irregularity of the image surface is increased, so that it is possible to reduce the degree of glossiness.

On the other hand, when irradiating light with a light amount higher than that, the toner is remelted, the entire image is smoothed, and the glossiness may be increased compared to before light irradiation.

Figure 2:
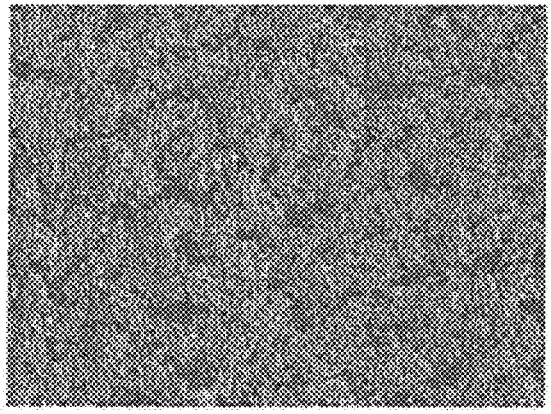
FIG. 2 is an observation diagram illustrating the surface of the toner image after irradiation with a low-intensity glossiness control light.
Figure 3:
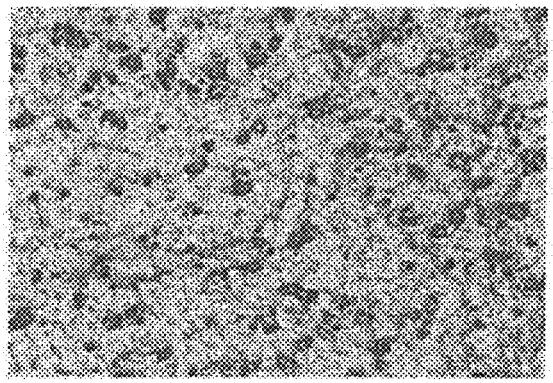
FIG. 3 is an observation diagram illustrating the surface of the toner image after irradiation with a high-intensity glossiness control light.

FIG. 1 to FIG. 3 illustrate images obtained by observing a toner image formed on a recording medium by a laser microscope. FIG. 1 illustrates the state of the surface of the toner image fixed on the recording medium before irradiating the glossiness control light.

FIG. 2 illustrates the state of the toner image surface when irradiated with glossiness control light of a low light amount which does not remelt the toner but softens the toner image illustrated in FIG. 1.

As illustrated in FIG. 2, the fixed toner is elastically recovered and the irregularities on the image surface are increased, so that the glossiness is reduced before light irradiation.

In addition, FIG. 3 indicates the state of the toner image surface when irradiating the toner image illustrated in FIG. 1 with glossiness control light of high light amount. As indicated in FIG. 3, the toner is remelted by light irradiation with a high light amount, the entire image is smoothed, and the glossiness increases compared to before light irradiation.

Figure 4:
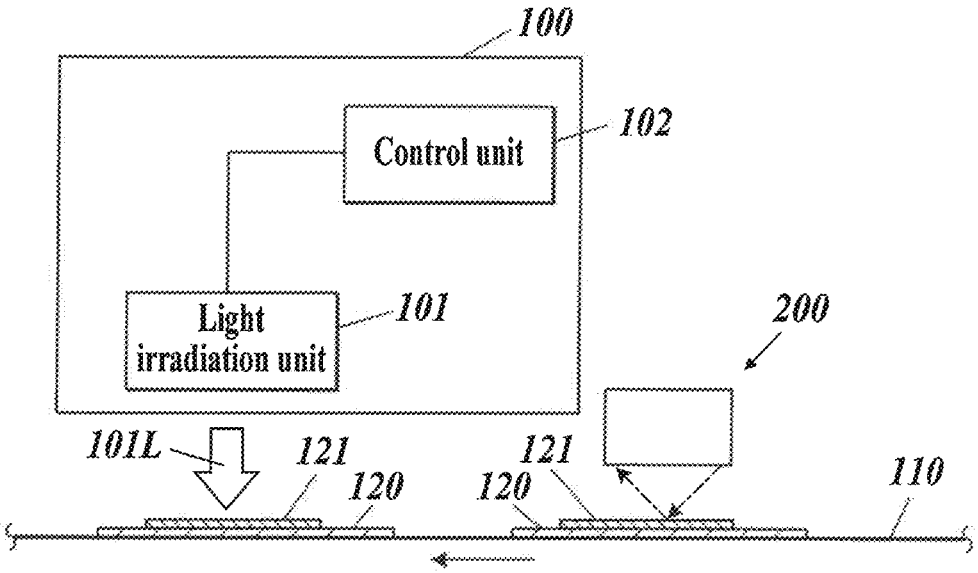
FIG. 4 is a schematic diagram illustrating a fixing unit, a glossiness detection unit and a glossiness control unit.

The glossiness control step is performed by the glossiness control unit 100 including the light irradiation unit 101 and the control unit 102 as illustrated in FIG. 4, for example.

When the recording medium 120 to which the toner image 121 has been fixed has moved to the glossiness control unit 100 by the conveyance belt 110, the light irradiation unit 101 irradiates the glossiness control light 101L to the toner image 121.

The control unit 102 instructs the light irradiation unit 101 the irradiation conditions such as the light amount of the light irradiated by the light irradiation unit 101 and the position condition such as the light irradiation position and irradiates the light irradiation unit 101 with the glossiness control light 101L.

The glossiness control light is preferably light having a maximum emission wavelength in a wavelength range of 280 nm to 850 nm. In order to reduce or increase the glossiness of the toner image, it is necessary to efficiently remelt the toner.

Therefore, a compound that absorbs light in a wavelength range of 280 nm to 850 nm having large excitation energy is incorporated in the toner, and by irradiating light having the maximum emission wavelength in a wavelength region absorbed by the compound (e.g., colorant and UV absorber) to the compound, it becomes easy to control the glossiness of the toner image.

From the viewpoint of making it easier to adjust the glossiness of the toner by efficiently remelting the toner, the maximum absorption wavelength of the compound absorbing the light contained in the toner and the emission wavelength of the glossiness control light are, made to coincide with each other.

In addition, the glossiness control light may be any light as long as it can at least reduce the glossiness of the toner image. That is, it may be light which can only reduce the glossiness, or light which can both decrease and increase the glossiness. Here, from the viewpoint of widening the range in which the glossiness can be controlled, it is preferable that the light is capable of both reducing and increasing the glossiness.

Figure 5:
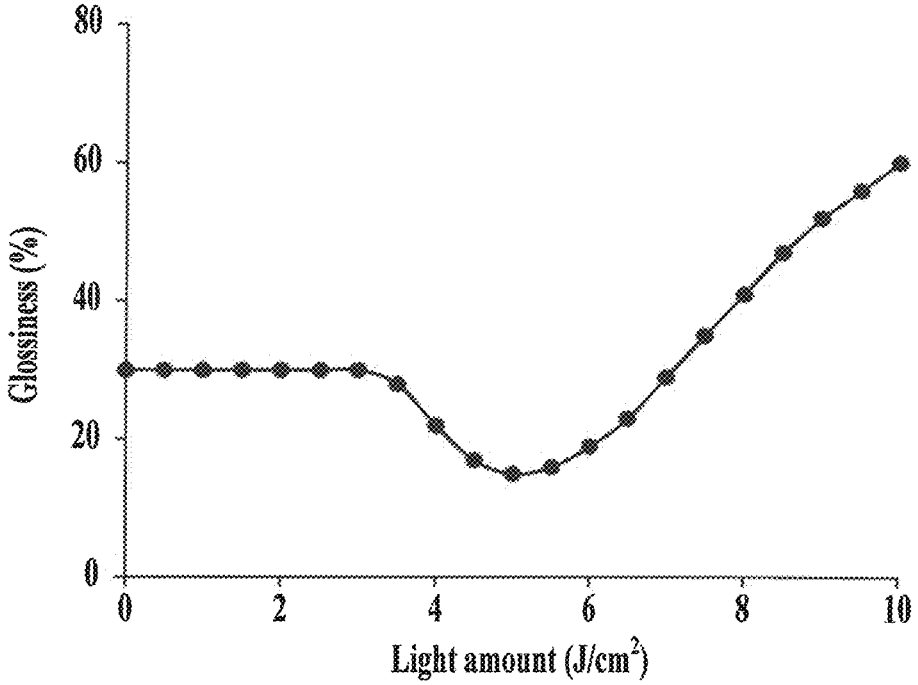
FIG. 5 is a graph indicating a change in the glossiness (%) of the toner image with respect to the light amount ($J/cm^2$) of the glossiness control light.

FIG. 5 illustrates a graph indicating a change in the glossiness (%) of the toner image with respect to the light amount (J/cm$^2$) of the glossiness control light. The graph illustrated in FIG. 5 is not a measured value but a typical example, and numerical values on the horizontal axis and the vertical axis are described for convenience of explanation.

In the glossiness control step, it is preferable to adjust the light amount of the glossiness control light based on the glossiness information designated by the user. With this, it is possible to irradiate the toner image with the glossiness control light with the amount of light having the glossiness designated by the user.

In the glossiness control step, the "glossiness information designated by the user" in the present invention refers to information that specifies how the user wishes to adjust the glossiness of the toner image.

For example, it may be a specific numerical value of the glossiness, and it may be a selection of how much glossiness is to be decreased or increased compared to the glossiness at the present time, and it may be a selection of simply whether to lower or raise the glossiness from the current glossiness.

Here, the glossiness information may be set, for example, when the glossiness is controlled by the post-processing apparatus, or when the image is printed by the image forming apparatus, by the user with an input screen. Then, the control unit 102 determines the light amount of the glossiness control light based on the glossiness information, the glossiness of the toner image may be changed by irradiating the toner image with the glossiness control light having the wavelength and light amount by using the light irradiation unit 101.

Adjustment of the light amount of the glossiness control light is preferably performed based on the relationship information on the change in the glossiness (%) of the toner image with respect to the light amount (J/cm$^2$) of the glossiness control light to be irradiated.

Thereby, it is possible to more precisely adjust the amount of light which achieves the glossiness designated by the user.

Relational information on the change in the glossiness (%) of the toner image with respect to the light amount (J/cm$^2$) of the glossiness control light is illustrated by the graph in FIG. 5, for example. This graph indicates the change in the glossiness (%) of the toner image with respect to the light amount (J/cm$^2$) of the glossiness control light when a certain toner image fixed on the recording medium is irradiated with predetermined glossiness control light.

The graph illustrated in FIG. 5 may be obtained as follows, for example. The glossiness control light s irradiated to a toner image (solid image) fixed on a recording medium at a predetermined maximum emission wavelength (for example, 365 nm) with an arbitrary light amount, and the glossiness to the irradiated light amount is plotted. The glossiness may be measured, for example, using a glossiness measuring instrument (MULTI GROSS 268 Plus, manufactured by Konica Minolta, Inc.). The glossiness (%) at an incident angle of 60° was measured for a total of five points, that is, an image center point of the toner image after the irradiation of the glossiness control light and two points at each 50 mm vertically from the image center in the major axis direction. The average value of 5 points may be calculated as glossiness (%).

In order to more precisely adjust the glossiness, it is preferable to have a step of detecting the glossiness of the toner image fixed on the recording medium before the glossiness control step. Here, with respect to the fixed toner image, a change in the glossiness (%) of the toner image with respect to the light amount (J/cm$^2$) when predetermined glossiness control light is irradiated as illustrated in FIG. 5 is obtained in advance. When the user specifies the numerical value of the glossiness (%), by irradiating the light amount corresponding thereto, it is possible to irradiate the glossiness control light so that the glossiness specified by the user is obtained.

In addition, there are cases where there are two or more irradiation light amounts for changing the glossiness to the specified glossiness. For example, in the example illustrated in FIG. 5, in order to reduce the glossiness to 20(%), light of about 4.0 J/cm$^2$ may be irradiated, or light of about 6.5 J/cm$^2$ may be irradiated. In this case, for example, from the viewpoint of light irradiation efficiency, it is preferable to irradiate a light with weaker light amount (light of about 4.0 J/cm$^2$).

In the gloss level control step, the irradiation position of the glossiness control light an be set based on the positional information of the toner image designated by the user.

In the image post-processing method of the present invention, it is possible to reduce or increase the glossiness only at the portion irradiated with the glossiness control light. Therefore, it is possible to reduce or increase the glossiness of only the specific position of the toner image by irradiating the glossiness control light only on the location specified by the user.

The "positional in of the toner image designated by the user" in the present invention means the position of the toner image which is designated by the user to reduce or raise the glossiness among the toner images fixed on the recording medium. Here, the positional information of the toner image whose glossiness is desired to be reduced or increased may be selected by any method as long as the position can be selected. For example, the user may designate in advance by an input screen, and the fixed toner image may be displayed on the display so that the user can designate the position while confirming the toner image displayed on the display. Then, the control unit 102 causes the light irradiation unit 101 to irradiate the glossiness control light based on the positional information. Thus, among the toner images, it is possible to reduce or increase the glossiness of only the portion of the specific position designated by the user.

Further, by performing light irradiation to a designated position, it is possible to adjust the gloss less of the fixed toner image at the designated position. Therefore, the image post-processing apparatus and the image forming apparatus that perform the image post-processing method of the present invention may also be used as a marking apparatus.

(Light Source)

Examples of a light source used for the light irradiation unit are a light emitting diode (LED) and a laser light source. One or more of the light sources may be installed.

The maximum emission wavelength of the glossiness control light is preferably within the wavelength range of 280 to 850 nm. When the maximum emission wavelength is less than 280 nm, bond cleavage of the compound occurs and thereby color reproducibility is reduced. When it is longer than 850 nm, it becomes difficult to obtain sufficient energy and it becomes difficult to give sufficient energy for changing glossiness.

The maximum emission wavelength of the glossiness control light is more preferably within the wavelength range of 280 to 500 nm. When the maximum emission wavelength is within this wavelength range, sufficient energy for changing the glossiness level may be obtained by the glossiness control light. Consequently, there is no need to change the light source depending on the type of the colorant used for the toner, and the space for the apparatus can be saved.

(Light Amount)

The irradiation light amount of the glossiness control light may be controlled within the range where the effect of the present invention can be obtained by the content of the compound that absorbs the light and contained in the toner. The irradiation amount is preferably set within the range of 0.01 to 100 J/cm$^2$, more preferably set within the range of 0.01 to 50 J/cm$^2$.

[Image Forming Apparatus]

The image forming apparatus according to the present invention is provided with: a transfer unit that transfers a toner image formed in a developing unit using a toner containing a compound that absorbs light onto a recording medium; a fixing unit that fixes the toner image formed on the recording medium; a glossiness control unit that reduces or increases the glossiness of the toner image fixed on the recording medium by irradiating glossiness control light having a maximum emission wavelength within a wavelength range in which the aforesaid compound absorbs light and is capable of at least reducing the glossiness of the toner image.

Hereinafter, an image forming apparatus applicable to the present invention is described in reference to the drawing.

Figure 6:
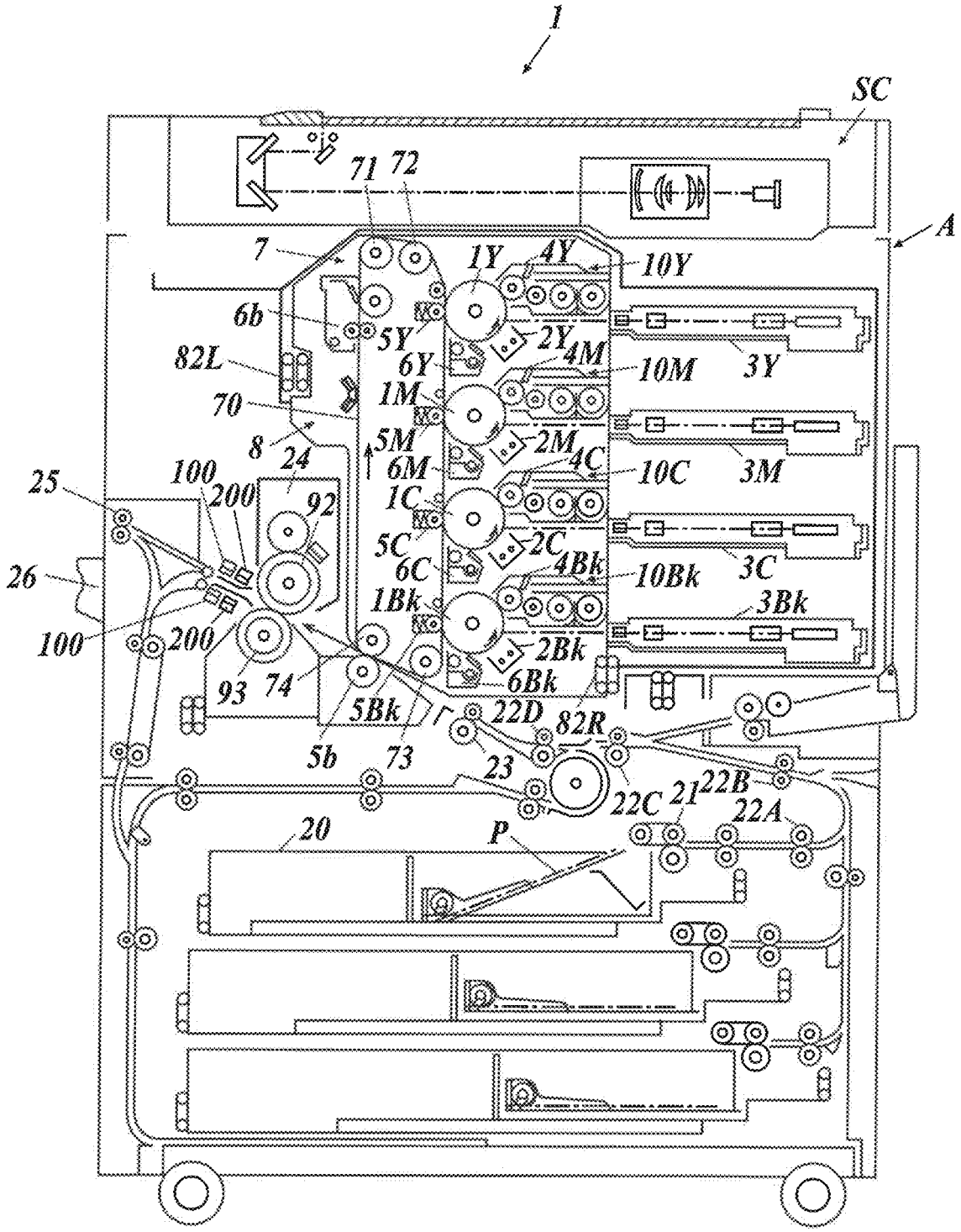
FIG. 6 is a schematic diagram illustrating a schematic configuration as an example of the image forming apparatus of the present invention.

An image forming apparatus 1 illustrated in FIG. 6 is referred to as a tandem color image forming apparatus, and includes four image forming units (process cartridge) 10Y, 10M, 10C, and 10Bk, an intermediate transferring unit 7 having an endless belt form, a sheet feeding unit 21, and a fixing unit 24. The image forming apparatus further includes a document scanner SC above a main body A of the image forming apparatus.

Four image forming units (process cartridge) 10Y, 10M, 10C, and 10Bk are included in the image forming apparatus according to FIG. 6, however, only an image forming unit Bk, or at least two image forming units among the four image forming units (process cartridge) 10Y, 10M, 10C, and 10Bk may be included in the image forming apparatus.

The image forming unit 10Y forms a yellow image. The image forming unit 10Y includes a drum shape electrophotographic photoreceptor 1Y, with a charging unit 2Y, an exposing unit 3Y, a developing unit 4Y, and a cleaning unit 6Y located around the photoreceptor 1Y. The image forming unit 10Y further includes a primary transfer roller 5Y.

The image forming unit 10M forms a magenta image. The image forming unit 10M includes a drum shape electrophotographic photoreceptor 1M, with a charging unit 2M, an exposing unit 3M, a developing unit 4M, and a cleaning unit 6M located around the electrophotographic photoreceptor 1M. The image forming unit 10M further includes a primary transfer roller 5M.

The image forming unit 10C forms a cyan image. The image forming unit 10C includes a drum shape electrophotographic photoreceptor 1C, with a charging unit 2C, an exposing unit 3C, a developing unit 4C, and a cleaning unit 6C located around the electrophotographic photoreceptor 1C. The image forming unit 10C further includes a primary transfer roller 5C.

The image forming unit 10Bk forms a black image. The image forming unit 10Bk includes a drum shape electrophotographic photoreceptor 1Bk, with a charging unit 2Bk, an exposing unit 3Bk, a developing unit 4Bk, and a cleaning unit 6Bk located around the electrophotographic photoreceptor 1Bk. The image forming unit 10Bk further includes a primary transfer roller 5Bk.

The image forming units 10Y, 10M, 10C, and 10Bk have the same configuration except for the colors of toner images formed on the electrophotographic photoreceptors 1Y, 1M, 1C, and 1Bk. Thus, the following description focuses on the image forming unit 10Y as an example.

In the present embodiment, in the image forming unit 10Y, at least the electrophotographic photoreceptor 1Y, the charging unit 2Y, the developing unit 4Y, and the cleaning unit 6Y are integrated.

The charging unit 2Y provides the electrophotographic photoreceptor 1Y with a uniform electric potential to charge the surface of the electrophotographic photoreceptor 1Y (for example, negatively charged). The charging unit 2Y may charge the surface of the electrophotographic photoreceptor 1Y by a non-contact charging method.

The exposing unit 3Y exposes the electrophotographic photoreceptor 1Y which has been given the uniform potential by the charging unit 2Y in response to image signals (yellow) to form an electrostatic latent image corresponding to the yellow image. The exposing unit 3Y includes light emitting devices (LEDs) arrayed in the axial direction of the electrophotographic photoreceptor 1Y and an imaging element (SELFOC (registered trade name)), or includes a laser optical device.

The developing unit 4Y forms a toner image by developing the electrostatic latent image which has been formed by the exposing unit 3Y with an electrostatic latent image developer. Although the electrostatic latent image developer is not specifically limited in the present invention, it is preferable to use a dry type developer.

In the image forming apparatus of the present embodiment, the electrophotographic photoreceptor 1Y, the charging unit 2Y, the exposing unit 3Y, the developing unit 4Y, and the cleaning unit 6Y are integrated as a process cartridge. This process cartridge may be detachably attached to the apparatus main body A. In addition, at least one of the charging unit 2Y, the exposing unit 3Y, the developing unit 4Y, transferring unit or separator unit, and the cleaning unit 6Y is integrally supported together with the electrophotographic photoreceptor 1Y to constitute a process cartridge. This process cartridge may be detachably attached to the apparatus main body A to form a single image forming unit (image forming unit). The single image forming unit may be detachably attached to the apparatus main body A using a guiding device such as a rail.

A housing 8 includes the image forming units 10Y, 10M, 10C, 10Bk, and the intermediate transferring unit 7. The housing 8 has a structure which may be drawn from the apparatus body A via rails 82L and 82R. In the housing 8, the image forming units 10Y, 10M, 10C, and 10Bk are arranged in cascade in the vertical direction. The intermediate transferring unit 7 is arranged in the left side of the photoreceptor 1Y, 1M, 1C, and 1Bk of FIG. 1. The intermediate transferring unit 7 contains: a rotatable endless belt type intermediate transfer belt 70 that is wound around rollers 71, 72, 73, and 74; first transfer rollers 5Y, 5M, 5C, and 5Bk; and a cleaning unit 6*b*.

The fixing unit 24 may have a pressure applying unit to press the toner image formed on the recording medium P.

The pressure applying unit includes a fixing roller 92 and a pressure applying roller 93. When a recording medium P having a toner image is supplied, the fixing roller 92 and the pressure applying roller 93 crimp the toner image onto the recording medium P.

The fixing roller 92 can heat the toner image on the recording medium P while the recording medium P passes through the fixing roller 92 and the pressure applying roller 93. The toner image softened by light irradiation is further softened by this heating, so that the fixing property of the toner image onto the recording medium P is further improved. The temperature of the fixing roller 92 is preferably within the range of 30 to 100° C., more preferably within the range of 40 to 100° C.

As illustrated in FIG. 4, a glossiness control unit 100 is provided with a light irradiation unit 101 and a control unit 102.

When the recording medium on which a toner image 121 is fixed moves to the glossiness control unit 100 by a conveyance belt 110, the light irradiation unit 101 irradiates the glossiness control light 101L to the toner image 121, and the glossiness of the image 121 is reduced or increased.

The control unit 102 instructs the light irradiation unit to the irradiation condition such as the light amount of the light irradiated by the light irradiation unit 101 and the position condition such as the irradiation position of the light and causes the light irradiation unit 101 to irradiate the glossiness control light 101L.

Further, it is preferable to provide a glossiness detection unit 200 for detecting glossiness between the fixing unit 24 and the glossiness control unit 100. Thereby, the glossiness of the toner image before irradiation with the glossiness control light can be measured. Consequently, it is possible for the glossiness control unit 100 to select whether to reduce or raise the detected glossiness after the user confirms the measured glossiness value.

It is also preferable to provide the glossiness detection unit 200 after the glossiness control unit 100. By this, it may be confirmed whether or not the desired glossiness can be adjusted by the irradiation of the glossiness control light performed by the glossiness control unit 100. Further, the glossiness control unit 100 may be configured to be able to irradiate the glossiness control light again after measurement by the glossiness detection unit 200.

In the following, an image forming method using an image forming apparatus illustrated in FIG. 6 will be described.

The color toner images formed in the image forming units 10Y, 10M, 10C, and 10Bk are sequentially transferred onto the rotating intermediate transferring member 70 with the respective first transferring rollers 5Y, 5M, 5C, and 5Bk, to form a synthesized color image on the intermediate transferring member 70.

A recording medium P accommodated in a sheet feeding cassette 20 is fed by the sheet feeding unit 21, and it is transported to a second transferring roller 5*b* via multiple intermediate rollers 22A, 22B, 22C, and 22D and register rollers 23. The synthesized color image is transferred to the recording medium P by the second transferring roller 5*b*. Thus, a color image is transferred to the recording medium collectively. After secondary transferring the synthesized color image on the recording medium P, the endless belt type intermediate transfer belt 70 will separate the recording medium P by curvature.

The toner image is fixed on the recording medium P by the fixing roller 92 and the pressure applying roller 93 in the fixing unit 24.

The recording medium P on which the toner image has been fixed is irradiated with the glossiness control light in the glossiness control unit 100, and the glossiness of the toner image is reduced or increased.

The recording medium P after subjected to the is then pinched between discharging rollers 25 and it is conveyed to a sheet receiving tray 26 provided outside of the apparatus. On the other hand, the electrostatic latent image developer (the residual toner) attached on the intermediate transferring member 70 is removed by the cleaning unit 6*b*.

During image formation, the first transfer roller 5Bk continuously abuts the surface of the electrophotographic photoreceptor 1Bk. On the other hand, the first transfer rollers 5Y, 5M, and 5C abut the surface of the corresponding electrophotographic photoreceptors 1Y, 1M, and 1C only when a color image is formed. Further, the second transfer roller 5*b* abuts the surface of the endless belt type intermediate transferring member 70 only when the recording medium P passes and the second transfer is performed.

[Image Post-Processing Apparatus and Image Forming Apparatus to Which the Image Post-Processing Apparatus is Connected]

An image post-processing apparatus of the present invention is provided with a glossiness control unit to reduce or increase a glossiness of a fixed toner image by irradiating the fixed toner image formed with a toner containing a compound that absorbs light and fixed on a recording medium with a glossiness control light that is capable of reducing a glossiness of the fixed toner image.

That is, the image post-processing apparatus of the present invention is an image post-processing apparatus having the glossiness control unit 100 (refer to FIG. 4) described in the image forming apparatus. It is preferable that this image post-processing apparatus is, for example, a detachable apparatus in an electrophotographic image forming apparatus.

Consequently, an image forming apparatus having a transfer unit for transferring a toner image formed in a developing unit using a toner containing a compound absorbing light onto a recording medium and a fixing unit for fixing to which the image post-processing apparatus of the present invention is connected is also within the scope of the present invention.

[Toner (Electrostatic Image Developing Toner)]

In the method of the present invention, a toner (an electrostatic image developing toner) containing a compound that absorbs light is used.

It is preferable that the toner according to the present invention is an assembly of toner mother particles or toner particles.

Here, toner particles are those obtained by adding an external additive to toner mother particles. The toner mother particles may be used as the toner particles without change.

<Compound that Absorbs Light>

The compound that absorbs light and is contained in the toner is preferably a compound that absorbs light within a wavelength range of 280 nm to 850 nm.

In the present invention "a compound that absorbs light within a wavelength range of 280 nm to 850 nm" refers to a compound when it is dissolved in a concentration of 0.01 mass % with respect to a solvent (DMF, THF, or chloroform), and the absorbance at an arbitrary wavelength in the wavelength range of 280 nm to 850 nm is 0.01 or more.

Preferable compounds that absorb light in the range of 280 nm to 850 nm and contained in the toner of the present invention are colorants of black, yellow, magenta and cyan and UV absorbers. The toner used in the present invention may contain one kind of compound that absorbs light in the range of 280 nm to 850 nm, or may contain two or more kinds.

<Colorant>

The toner particles according to the present invention preferably contain a colorant as the aforesaid light absorbing compound. As the colorant, commonly known dyes and pigments may be used.

Examples of a colorant to obtain a black toner are: carbon black, a magnetic material, and iron-titanium complex oxide black. Examples of carbon black that may be used include channel black, furnace black, acetylene black, thermal black, and lamp black. Examples of a magnetic material that may be used include: ferrite and magnetite.

Examples of a colorant to obtain a yellow toner are: dyes such as C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. and solvent yellow 162; and pigments such as C.I. pigment yellow 14, C.I. pigment yellow 17, C.I. pigment yellow 74, C.I. pigment yellow 93, C.I. pigment yellow 94, C.I. pigment yellow 138, C.I. pigment yellow 155, C.I. pigment yellow 180, and C.I. pigment yellow 185.

Examples of a colorant to obtain a magenta toner are: dyes such as C.I. solvent red 1, C.I. solvent red 49, C.I. solvent red 52, C.I. solvent red 58, C.I. solvent red 63, C.I. solvent red 111, and C.I. solvent red 122; and pigments such as C.I. pigment red 5, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 166, C.I. pigment red 177, C.I. pigment red 178, and C.I. pigment red 222.

Examples of a colorant to obtain a cyan toner are: dyes such as C.I. solvent blue 25, C.I. solvent blue 36, C.I. solvent blue 60, C.I. solvent blue 70, C.I. solvent blue 93, and C.I. solvent blue 95; and pigments such as C.I. pigment blue 1, C.I. pigment blue 7, C.I. pigment blue 15, C.I. pigment blue 60, C.I. pigment blue 62, C.I. pigment blue 66, C.I. pigment blue 76, C.I. pigment blue 76, and C.I. pigment blue 15:3.

One kind of colorant or a combination of two or more kinds of colorants may be used to obtain each toner.

A content of the colorant in the toner with respect to the total mass (100 mass %) of the toner is preferably in the range of 1 to 30 mass %, and more preferably in the range of 2 to 20 mass %. When the content is 1 mass % or more, sufficient coloring power may be obtained, and when it is 30 mass % or less, the colorant is not released from the toner to result in adhering to the carrier, and the charging property is stabilized. Therefore, a high-quality image may be obtained.

<Ultraviolet Light Absorber (UV Absorber)>

It is preferable that the toner particles according to the present invention contain a UV absorber as a compound that absorbs the above-described light.

The UV absorber according to the present invention refers to an additive that has an absorbing wavelength in the wavelength range of 180 to 400 nm and is deactivated from an excited state by non-radiative deactivation without structure change such as isomerization or bond cleavage at least under an environment where the temperature is 0° C. or more. The UV absorber may be an organic compound or an inorganic compound as long as it satisfies these requirements. In addition to ordinary organic UV absorbers, additives such as light stabilizers and antioxidants also are also referred to the UV absorbers in the present invention.

Additionally, UV absorbing polymer having a polymer chain including functional groups of organic UV absorber skeleton may be used.

The UV absorber preferably has a maximum absorption wavelength in the range of 180 to 400 nm. An organic UV absorber is more preferred than an inorganic UV absorber.

Examples of organic UV absorbers used in the present invention include known organic UV absorbers such as a benzophenone UV absorber, a benzotriazole UV absorber, a triazine UV absorber, a cyanoacrylate UV absorber, a salicylate UV absorber, a benzoate UV absorber, a diphenylacrylate UV absorber, a benzoic acid UV absorber, a salicylic acid UV absorber, a cinnamic acid UV absorber, a dibenzoylmethane UV absorber, a β,β-diphenylacrylate UV absorber, a benzylidene camphor UV absorber, a phenyl benzimidazole UV absorber, an anthranil UV absorber, an imidazoline UV absorber, a benzalmalonate UV absorber, and a 4,4-diaryl butadiene UV absorber. Among them, a benzophenone UV absorber, a benzotriazole UV absorber, a triazine UV absorber, a cyanoacrylate UV absorber, and a dibenzoylmethane UV absorber are preferably used.

They may be used alone or in combination of two or more kinds

Examples of the benzophenone UV absorber (UV absorber including a benzophenone compound) include octabenzone, 2,4-hydroxybenzophenone, 2-hydroxy-4-methoxybenzophenone, and 2-hydroxy-4-n-octyloxybenzophenone.

Examples of the benzotriazole UV absorber (UV absorber including a benzotriazole compound) include 2-(2E-benzotriazole-2-yl)-p-cresol, 2-(2H-benzotriazole-2-yl)-4,6-bis(1-methyl-1-phenylethyl)phenol, 2-[5-chloro(2H)-benzotriazole-2-yl]-4-methyl-6-(tert-butyl)phenol, 2-(2H-benzotriazole-2-yl)-4,6-di-tert-pentylphenol, 2-(2H-benzotriazole-2-yl)-4-(1,1,3,3-tetramethylbutyl)phenol, reaction products of meth 3-[3-t-butyl-5-(2H-benzotriazole-2-yl)-4-hydroxyphenyl]propionate/polyethylenglycol (molecular weight: about 300), 2-(2H-benzotriazole-2-yl)-6-dodecyl-4-methylphenol, 2-(2-hydroxy-5-tert-buty phenyl)-2H-benzotriazole, 2-ethylhexyl-3-[3-tert-butyl-4-hydroxy-5-(5-chloro-2H-benzotriazole-2-yl)phenyl]propionate, 2-(2H-benzotriazole-2-yl)-4,6-bis(1-methyl-1-phenylethyl) phenol, and 2-(2H-benzotriazole-2-yl)-6-(1-methyl~1-phenylethyl)-4-(1,1,3,3-tetramethylbutyl)phenol.

Examples of the triazine UV absorber (UV absorber including a triazine compound) include: 2-(4,6-bis(2,4-dimethylphenyl)-1,3,5-triazin-2-yl)-5-hydroxyphenyl, 2-(4,6-diphenyl-1,3,5-triazin-2-yl)-5-(hexyloxy)phenol, 2-[4-[(2-hydroxy-3-dodecyloxypropyl)oxy]-2-hydroxyphenyl]-4,6-bis(2,4-dimethylphenyl)-1,3,5-triazine, 2-[4-[(2-hydroxy-3-(2'-ethyl)hexyl)oxy]-2-hydroxyphenyl]-4,6-bis(2,4-dimethylphenyl)-1,3,5-triazine, 2,4-bis(2-hydroxy-4-butyloxyphenyl)-6-(2,4-bis-butyloxyphenyl)-1,3,5-triazine, and 2-(2-hydroxy-4-[1-octyloxycarbonylothoxy]phenyl)-4,6-bis(4-phenyl)-1,3,5-triazine.

Examples of the cyanoacrylate UV absorber (UV absorber including a cyanoacrylate compound) include ethyl2-cyano-3,3-diphenylacrylate and 2'-ethylhexyl2-cyano-3,3-diphenylacrylate.

Examples of the dibenzoylmethane UV absorber (UV absorber including a dibenzoylmethane compound) include 4-tert-butyl-4'-methoxydibenzoylmethane (for example, "Parsol 1789" manufactured by DSM).

Examples of the inorganic UV absorber include titanium oxide, zinc oxide, cerium oxide, iron oxide, and barium sulfate. The diameter of the inorganic UV absorber is preferably within 1 nm to 1 μm.

The content of the UV absorber is in the range of 0.1 to 50 mass % with respect to the total mass (100 mass %) of the toner particles. If the content is less than 0.1 mass %, sufficient heat (energy) cannot be obtained. If the content is more than 50 mass %, the fixed image easily peels off.

The content of the UV absorber preferably within the range of 0.5 to 35 mass %. When the content is 0.5 mass % or more, obtained heat energy becomes so large that fixing property is further improved. When the content is 35 mass % or less, the ratio of resin becomes so large that the image is strongly fixed and that fixing property is further improved.

It is preferable that the toner particles according to the present invention contain a binder resin, a releasing agent, a charge control agent and an external additive. These are described in the following.

<Binder Resin>

It is preferable that the binder resin contains an amorphous resin and a crystalline resin.

When the toner particles according to the present invention include the binder resin, the toner has suitable viscosity and suppresses bleeding when applied on paper, and thereby improves reproducibility of thin lines and reproducibility of dots.

<Binder Resin>

In the toner according to the present invention, a generally used binder resin constituting toner particles may be contained without limitation. Specific examples thereof are: styrene resin, acrylic resin, styrene-acrylic resin, polyester resin, silicone resin, olefin resin, amide resin, and epoxy resin. These binder resins may be used alone, or they may be used in combination of two or more kinds.

Among these resins, it is preferable to use at least one selected from the group consisting of styrene resin, acrylic resin, styrene-acrylic resin, and polyester resin from the viewpoint of becoming low viscosity when melted, and having a highly sharp melt property. It is more preferable to use at least one selected from the group consisting of styrene-acrylic resin and polyester resin.

A glass transition temperature ($T_g$) of a binder resin is preferably in the range of 30 to 70° C. from the viewpoint of fixability and heat-resisting storage property. More preferably, it is preferably in the range of 35 to 60° C. $T_g$ may be measure with differential scanning colorimetry (DSC).

It is preferable that the toner according to the present invention contains a crystalline polyester resin as a crystalline resin used for a binder from the viewpoint of improving low-temperature fixability. In addition, from the viewpoint of further improving low-temperature fixability of the toner, it is preferable to contain a hybrid crystalline polyester resin which is formed with a crystalline polyester resin segment and an amorphous resin segment as a crystalline polyester resin. As the crystalline polyester resin and the hybrid crystalline polyester resin, for example, known compounds described in JP-A 2017-37245 may be used.

Toner particles containing a binder resin may have a single layer structure or a core-shell structure. The kind of the binder resin used for the core particle and the shell layer of the core-shell structure is not particularly limited.

<Releasing Agent>

The toner according to the present invention may contain a releasing agent. A usable releasing agent is not limited in particular. Various known waxes may be used. Examples of a wax are: low molecular weight polypropylene, polyethylene or oxidized low molecular weight polypropylene, polyolefin such as polyethylene, paraffin, and synthetic ester wax. It is particularly preferable to use a synthetic ester wax such as behenyl behenate, glycerin tribehenate, or pentaerythritol tetrabehenate.

A content ratio of a releasing agent is preferably in the range of 1 to 30 mass % in the toner, more preferably it is in the range of 3 to 15 mass %.

<Charge Control Agent>

The toner according to the present invention may contain a charge control agent. The used charge control agent is not limited in particular as long as it is a substance that is capable of providing positive or negative charge by a triboelectric charging, and colorless. Various known charge control agents that are positively chargeable or negatively chargeable may be used.

The content ratio of the charge control agent in the toner is preferably in the range of 0.1 to 30 mass %, and more preferably it is in the range of 0.1 to 10 mass % to the total mass of toner particles (100 mass %).

<External Additive>

In order to improve fluidity, charging property, and cleaning property of the toner, an external additive such as fluidity increasing agent and cleaning assisting agent may be added as an after treatment agent to constitute the toner of the present invention.

Examples of an external additive are: inorganic oxide particles such as silica particles, alumina particles, and titanium oxide particles; inorganic stearic acid compound particles such as aluminum stearate particles and zinc stearate particles; and inorganic particles of inorganic titanium acid compound particles such as strontium titanate particles and zinc titanate particles. These may be used alone, or they may be used in combination of two or more kinds.

From the viewpoint of improving heat-resisting storage stability and environmental stability, these inorganic particles may be subjected to a surface treatment by using a silane coupling agent, a titanium coupling agent, a higher aliphatic acid, or a silicone oil.

An added amount of the external additive in the toner is preferably in the rage of 0.05 to 5 mass % to the total mass of toner particles (100 mass %). More preferably, it is in the rage of 0.1 to 3 mass %.

<Average Particle Size of Toner Particles>

It is preferable that the toner particles of the present invention have an average particle size of 3 to 10 μm, more preferably 4 to 7 μm in volume-based median diameter ($D_{50}$). When the volume-based median diameter ($D_{50}$) is within the above-described range, the transfer efficiency is improved, the image quality of halftone is improved, and the image quality such as fine lines and dots is improved.

In the present invention, the volume-based median diameter ($D_{50}$) of the toner particles is measured and calculated by using measuring equipment composed of a "COULTER COUNTER 3" (Beckman Coulter Inc.) and a computer system installed with data processing software "Software V3.51" (Beckman Coulter Inc.) connected thereto.

In the measuring process, 0.02 g of sample to be measured (the toner particles) is blended in 20 mL of the surfactant solution (for the purpose of dispersing toner particles, for example, a surfactant solution in which a neutral detergent including a surfactant component is diluted by 10 times with pure water), ultrasonic dispersion is performed for 1 minute and a toner particle dispersion liquid is made. This toner particle dispersion liquid is poured into a beaker including ISOTON II (manufactured by Beckman Coulter, Inc.) in the sample stand with a pipette until the measurement concentration is 8 mass %.

By setting this content range, it is possible to obtain a reproducible measurement value. Then, the liquid is measured by setting the counter of the particle to be measured to 25,000. The aperture diameter is set to be 50 μm. The frequency count is calculated by dividing the range of the measurement range 1 to 30 μm by 256. The particle size where the accumulated volume counted from the largest size reaches 50% is determined as the volume-based median diameter ($D_{50}$).

<Manufacturing Method of Toner>

The manufacturing method of the toner according to the present invention is not particularly limited. Although any known methods may be used, an emulsion polymerization aggregation method and an emulsion aggregation method are suitably used. An example of the manufacturing method of the toner having toner particles containing UV absorber particles and a colorant is described in the following.

The emulsion polymerization aggregation method is a method in which toner particles are manufactured as follows: a dispersion liquid of binder resin particles prepared by the emulsion polymerization method (they may be called as "binder resin particles"), a dispersion liquid of UV absorber particles, a dispersion liquid of colorant particles, and a dispersion liquid of releasing agent such as wax are mixed and aggregated until toner particles have a desired diameter; and fusion among the binder resin particles is further conducted to control the shape.

The emulsion aggregation method is a method in which toner particles are manufactured as follows: a binder resin solution obtained by dissolving a binder resin in a solvent is added dropwise into a poor solvent; the resin particle dispersion liquid, an UV absorber particle dispersion liquid, a colorant particle dispersion liquid, and a dispersion liquid of release agent such as wax are mixed and aggregated until toner particles have a desired diameter; and fusion among the binder resin particles is further conducted to control the shape.

The toner according to the present invention may be manufactured by either manufacturing method.

An example of a case where the emulsion polymerization aggregation method is used for producing the toner of the present invention is described below.

(1) A step of preparing a dispersion liquid in which colorant particles are dispersed in an aqueous medium;
(2) A step of preparing a dispersion liquid in which UV absorber particles are dispersed in an aqueous medium;
(3) A step of preparing a dispersion liquid in which binder resin particles containing an internal additive as needed are dispersed in an aqueous medium;
(4) A step of preparing a binder resin particle dispersion liquid by emulsion polymerization;
(5) A step of forming toner mother particles by mixing the colorant particle dispersion liquid, the UV absorber particle dispersion liquid, and the binder resin particle dispersion liquid to aggregate, associate, and fuse the colorant particles, the UV absorber particles, and the binder resin particles;
(6) A step of removing a surfactant and the like by filtering the toner mother particles from a dispersion system (aqueous medium) of the toner mother particles;
(7) A step of drying the toner mother particles; and
(8) A step of adding an external additive to the toner mother particles.

When the toner is manufactured by the emulsion polymerization aggregation method, the binder resin particles obtained by emulsion polymerization may have a multilayer structure of two or more layers composed of binder resins of different composition. The binder resin particles of such structure, such as a two-layer structure can be obtained as follows: emulsion polymerization (first polymerization) in accordance with a usual method is performed to prepare a the resin particle dispersion liquid; a polymerization initiator and a polymerizable monomer are added to the dispersion liquid; and polymerization (second polymerization) of the system is performed.

Toner particles having a core-shell structure may be obtained by the emulsion polymerization aggregation method. Specifically, the toner particles having a core-shell structure are prepared as follows: first, core particles are prepared by aggregating, associating, and fusing binder resin particles, UV absorber particles, and colorant particles for core particles; and subsequently, binder resin particles for shell layer are added to the core particle dispersion liquid so as to aggregate and fuse the binder resin particles for shell layer on the surface of the core particles to form a shell layer coating the surface of the core particles.

<Developer>

The toner according to the present invention may be suitably used, for example, as a single-component magnetic toner including a magnetic material, as a two-component developer mixed with so-called a carrier, or as a nonmagnetic toner alone.

For example, magnetite, γ-hematite, or various kinds of ferrite may be used as the magnetic material.

The carrier composing the two-component developer may be magnetic particles composed of conventionally known materials including a metal such as iron, steel, nickel, cobalt, ferrite, and magnetite, and an alloy of the metal with a metal such as aluminum or lead.

Preferably used carriers include a coated carrier including magnetic particles having a surface coated by a coating agent such as a resin, and a so-called resin dispersed-type carrier including magnetic material powder dispersed in a binder resin. Examples of resin for coating include, but not particularly limited to, olefin resin, styrene resin, styrene-acrylic resin, silicone resin, polyester resin, fluororesin, and the like. Examples of resin for the resin dispersed-type carrier include, but not particularly limited to, known resins such as acrylic resin, styrene-acrylic resin, polyester resin, fluororesin, and phenol resin.

It is preferable that the carrier has volume-based median diameter within the range of 20 to 100 μm, more preferably 25 to 80 μm. The volume-based median diameter of the carrier can be measured by a laser diffraction particle size analyzer "HELOS" (manufactured by SYMPATEC GmbH) including a wet dispersion device.

The amount of toner mixed to carrier is preferably within the range of 2 to 10 mass % with respect to the total mass of the toner and the carrier (100 mass %).

Although the embodiments of the present invention have been described and illustrated in detail, the disclosed embodiments are made for purpose of illustration and example only and not limitation. The scope of the present invention should be interpreted by terms of the appended claims.

EXAMPLES

Hereinafter, the present invention will be described by referring to specific examples, but the present invention is not limited thereto.

[Preparation Method of Toner]

<Synthesis of Crystalline Polyester 1>

Raw material monomers for an addition polymerization resin (styrene-acrylic resin: StAc) unit including a bireactive monomer and a radical polymerization initiator as described below were loaded in a dropping funnel.

Styrene: 34 mass parts n-Butyl acrylate: 12 mass parts

Acrylic acid: 2 mass parts

Di-t-butylperoxide (polymerization initiator): 7 mass parts

Raw material monomers for a poly-condensation resin (crystalline polyester resin: CPEs) unit were introduced in a four-necked flask equipped with a nitrogen introducing device, a dehydration tube, a stirrer, and a thermocouple. Then, the mixture was heated to 170° C. to dissolve the content.

Sebacic acid: 281 mass parts 1,12-Dodecanediol: 283 mass parts

Subsequently, the raw material monomers for an addition polymerization resin (styrene-acrylic resin: StAc) was dropped over a period of 90 minutes, and an aging reaction was done for 60 minutes. Then, the unreacted raw material monomers for an addition polymerization resin were removed under a reduced pressure of 8 kPa. The amount of the removed monomers was very small compared with the raw monomers for the above-described resin.

Then, 0.8 mass parts of $Ti(OBu)_4$ were added as an esterification catalyst, and the mixture was heated to 235° C. The reaction was made under a normal pressure (101.3 kPa) for 5 hours, then further the reaction was made under a reduced pressure (8 kPa) for 1 hour.

Subsequently, the reaction mixture was cooled to 200° C., and the reaction was made under a reduced pressure (20 kPa) for 1 hour. Thus, a hybrid crystalline polyester resin 1 was obtained.

The obtained hybrid crystalline polyester resin 1 contained 8 mass % of resin unit other than CPEs (StAc) with respect to the total amount, and it was a resin having a grafted structure of CPEs to StAc. The obtained hybrid crystalline polyester resin 1 had a number average molecular weight (Mn) of 9,000 and a melting point ($T_c$) of 75° C.

<Preparation of Crystalline Resin Fine Particle Dispersion Liquid (C1)>

30 mass parts of the crystalline polyester resin 1 were melted, and the resin in the melted state was transferred to an emulsifying disperser "Cavitron CD1010" (manufactured by Eurotec) at a transfer rate of 100 mass parts per minute. Currently with the transfer of the resin 1 in the melted state, a dilute ammonia solution having a concentration of 0.37 mass % was transferred to the emulsifying disperser at a transfer rate of 0.1 L per minute while heating to 100° C. with a heat exchanger. The dilute ammonia solution was prepared in an aqueous solvent tank by diluting a reagent ammonia water (70 mass parts) with ion-exchanged water.

The emulsifying disperser was operated under conditions of a rotation rate of the rotor of 60 Hz and a pressure of 5 $kg/cm^2$ (490 kPa) to prepare a crystalline resin particle dispersion liquid (C1) containing crystalline polyester resin 1 having a solid content of 30 parts by mass. The particles in the crystalline resin particle dispersion liquid (C1) had a volume-based median diameter ($D_{50}$) of 200 nm.

<Preparation of Amorphous Resin Particle Dispersion Liquid (X1)>

(1) First Polymerization

Into a 5 L reaction vessel equipped with a stirrer, a temperature sensor, a cooling tube, and a nitrogen introducing device, mass parts of sodium dodecyl sulfate and 3,000 mass parts of ion-exchanged water were charged. While stirring at a stirring speed of 230 rpm under a nitrogen flow, the inner temperature of the reaction vessel was raised to 80° C. After the temperature was raised, a solution of 10 mass parts of potassium persulfate dissolved in 200 mass parts of ion-exchanged water was added thereto, and the liquid temperature was raised again to 80° C. To this solution was dropwise added a polymerizable monomer solution including the following Monomer mixture 1 over 1 hour. Then, the reaction system was heated and stirred at 80° C. for 2 hours to carry out the polymerization. Thus, a resin particle dispersion liquid (x1) was prepared.

(Monomer Mixture 1)

Styrene: 480 mass parts n-Butyl acrylate: 250 mass parts

Methacrylic acid: 68 mass parts (2) Second Polymerization

Into a 5 L reaction vessel equipped with a stirrer, a temperature sensor, a cooling tube, and a nitrogen introducing device, a solution of 7 mass parts of sodium dodecyl ether sulfate dissolved in 3000 mass parts of ion-exchanged water was charged. After heating the solution to 98° C. were added 260 mass parts of the above resin particle dispersion liquid [X1] and a polymerizable monomer solution including the following Monomer mixture 2 including releasing agent dissolved at 90° C. The reaction system was mixed and dispersed for 1 hour by using a mechanical disperser with a circulation route "CLEARMIX" (manufactured by M Technique Co., Ltd.) so that a dispersion liquid containing emulsion particles (oil particles) was prepared.

(Monomer Mixture 2)

Styrene (St): 284 mass parts n-Butyl acrylate (BA): 92 mass parts

Methacrylic acid (MAA): 13 mass parts n-Octyl-3-mercaptopropionate: 1.5 mass parts Releasing agent (Behenyl behenate m. p. 73° C.): 190 mass parts Then, an initiator solution of 6 mass parts of potassium persulfate dissolved in 200 mass parts of ion-exchanged water was added to the dispersion liquid, and the system was heated and stirred at 84° C. for 1 hour to carry out polymerization. A resin particles dispersion liquid (x2) was thus prepared.

(3) Third Polymerization

To the resin particles dispersion liquid (x2) was 400 mass parts of ion-exchanged water. After mixing the mixture, a solution of 11 mass parts of potassium persulfate dissolved in 400 mass parts of ion-exchanged water was added to the mixture. Then, a polymerizable monomer solution including the following Monomer mixture 3 was added dropwise thereto at a temperature of 82° C. over 1 hour. After completion of the addition, the solution was hated with stirring for 2 hours to carry out polymerization. After cooling to 28° C., an amorphous resin particle dispersion liquid (X1) containing a vinyl resin (styrene-acrylic resin) was prepared.

(Monomer Mixture 3)

Styrene (St): 350 mass parts n-Butyl acrylate (BA): 215 mass parts

Acrylic acid (AA): 30 mass parts n-Octyl-3-mercapto propionate: 8 mass parts.

The physical properties of the prepared amorphous resin particle dispersion liquid [X1] were measured. The particles in the amorphous resin particle dispersion liquid (X1) had a volume-based median diameter ($D_{50}$) of 200 nm, glass transition temperature of 55° C. and a weight average molecular weight (Mw) of 32000.

<Preparation of Colorant Particle Dispersion Liquid [Bk]>

90 mass parts of sodium n-dodecyl sulfate were added to 1600 mass parts of ion-exchanged water. While stirring the solution, 420 mass parts of carbon black "Regal 330R" (manufactured by Cabot Corp.) were gradually added to the solution. Subsequently, by dispersion with a stirrer "CLEARMIX" (manufactured by M Technique Co., Ltd.), Black colorant particle dispersion liquid [Bk] was prepared.

The volume-based median diameter of the colorant particle dispersion liquid [Bk] was measured with Electrophoretic light scattering photometer "ELS-800" (manufactured by Otsuka Electronics Co., Ltd.). The volume-based median diameter was 120 nm.

<Preparation of Toner T1>

Into a reaction vessel equipped with a stirrer, a temperature sensor and a cooling tube were charged 195 mass parts (in solid fraction) of the amorphous resin particle dispersion liquid (X1) and 200 mass parts of ion-exchanged water. Thereafter, the pH of the dispersion liquid in the reaction vessel was adjusted to pH 10 by adding a 5 mol/L sodium hydroxide aqueous solution.

Thereafter, 40 mass parts (in solid fraction) of the colorant particle dispersion liquid [Bk] was added the amorphous resin particle dispersion liquid (X1) after adjustment of pH. Then, while stirring, an aqueous solution of 30 mass parts of magnesium chloride dissolved in 60 mass parts of ion-exchanged water was added at 30° C. over a period of 10 minutes as a coagulant. The temperature of the system was raised to 60° C. at a raising rate of 0.8° C./min. After raised to 60° C., 20 mass parts of the crystalline resin particle dispersion liquid (C1) (crystalline polyester1) were added over 10 minutes. Then the temperature of the system was raised to 80° C. at a raising rate of 0.8° C./min. While keeping the temperature to be 80° C., the aggregation of the particles was proceeded. When the particle diameter of the aggregated particles was increased to have a volume-based median particle diameter $D_{50}$ of 6.0 μm measured with a "Coulter Multisizer 3" (manufactured by Beckman Coulter, Inc.), a solution of 190 mass parts of sodium chloride dissolved in 760 mass parts of ion-exchanged water was added to stop the particle size increase. While stopping the increase of the particle size, the particles was allowed to proceed fusing by heating and stirring at 80° C. to have an average circularity of the toner mother particle precursor reached 0.945. The average circularity was measured with a measuring apparatus "FPIA-2100" (manufactured by Sysmex Co.) by HPF detection of 4000 pieces. Then, the system was cooled to 30° C. at a cooling rate of 2.5° C./min.

The volume-based median diameter of the aggregated particles in the mixture at the time of adding the crystalline resin particle dispersion liquid (C1) was 0.80 μm. The volume-based median diameter ($D_{50}$) was measured using the micro track particle diameter distribution measurement apparatus "UPA-150" (manufactured by Nikkiso Co., Ltd.).

Then, the above-described particles were separated from the cooled reaction solution. The obtained toner cake was dehydrated, and it was washed by repeating re-dispersion in ion-exchanged water and solid-liquid separation for 3 times. Thereafter, the toner cake was dried at 40° C. for 24 hours to yield toner particles.

To 100 mass parts of the obtained toner particles were added 0.6 mass parts of hydrophobic silica (number average primary-particle diameter=12 nm, hydrophobicity=68) and 1.0 mass parts of hydrophobic titanium oxide (number average primary-particle diameter=20 nm, hydrophobicity=63). The mixture was blended at 32° C. for 20 minutes by using a "Henschel mixer" (Nippon Coke & Engineering Co., Ltd.) in the condition of a rotary blade circumferential speed of 35 mm/sec. After mixing, coarse particles were removed by using a filter having an opening size of 45 μm. Thus, a toner T1 was obtained.

<Preparation of Toner T2>

A toner T2 was prepared in the same manner as preparation of the toner T1 except that the following dispersion liquid of magenta colorant particles (M-1) was used in place of the dispersion liquid of black colorant particles [Bk].

(Preparation of Magenta Colorant Particle Dispersion Liquid (M-1))

95 mass parts of sodium n-dodecyl sulfate were added to 1600 mass parts of ion-exchanged water. While stirring this solution, 250 mass parts of C. I. Pigment Red 122 were gradually added to the solution. Then, the liquid was dispersed with a stirrer "CLEARMIX" (manufactured by M Technique Co., Ltd.) to prepare a magenta colorant particle dispersion liquid of (M-1).

A volume-based median diameter of the colorant particles in the magenta colorant particle dispersion liquid (M-1) was 115 nm.

<Preparation of Toner T3>

A toner T3 was prepared in the same manner as preparation of the toner T1 except that a UV absorber (UV-1) was further added as indicated in the following.

(Preparation of UV Absorber Particle Dispersion Liquid (UV-1))

80 mass parts of dichloromethane and 20 mass parts of benzophenone UV absorber (Uvinul3049, manufactured by BASF Japan Co. Ltd.) was mixed and stirred while heating at 50° C. to obtain a liquid including a UV absorber. To 100 mass parts of this liquid was added a mixed liquid of 99.5 mass parts of distilled water heated to 50° C. and 0.5 mass parts of 20 mass % sodium dodecylbenzenesulfonate aqueous solution. Then, by stirring at 16000 rpm for 20 minutes using a homogenizer having a shaft generator 18F (manufactured by Heidolph Instruments GmbH & CO. KG) for emulsification, a UV absorber emulsion liquid 1 was obtained.

The obtained UV absorber emulsion liquid 1 was put into a separable flask. While supplying nitrogen into the gas phase, the UV absorber emulsion liquid 1 was heated and stirred at 40° C. for 90 minutes to remove the organic solvent. Thereby a UV absorber particle dispersion liquid (UV-1) particle dispersion liquid (UV-1) was obtained.

The average diameter of the UV absorber particles in the UV absorber particle dispersion liquid (UV-1) was measured using the electrophoretic light scattering photometer "ELS-800" (manufactured by Otsuka Electronics Co., Ltd.). It was 145 nm in weight average particle size.

(Preparation of Toner 3)

Into a reaction vessel equipped with a stirrer, a temperature sensor, and a cooling tube were added 155 mass parts (in solid fraction) of amorphous resin particle dispersion liquid (X1) and 2000 mass parts of ion-exchanged water. Then, the mixture was adjusted to pH 10 by adding a 5 mol/L sodium hydroxide aqueous solution. To the amorphous resin particle dispersion liquid (X1) after adjusted to pH 10 were added 40 mass parts (in solid fraction) of colorant particle dispersion liquid [Bk] and 40 mass parts (in solid fraction) of UV absorber particle dispersion liquid (UV-1). The operations thereafter were performed in the same manner as the method for preparing the toner T1 to obtain a toner T3.

<Preparation of Developer>

A ferrite carrier covered with a copolymer resin of cyclohexyl methacrylate and methyl methacrylate (monomer mass ratio=1:1) and having a volume average particle size of 30 μm was added to the above-described toners T1 to T3 so that the content of the toner particles became to be 6 mass %. Thus, developers 1 to 3 were prepared. Blending of the developers was carried out for 30 minutes by using V-type mixer as a mixer.

<Preparation of Evaluation Instrument>

An image forming apparatus "bizhub PRESS C1080" (manufactured by Konica Minolta, Inc.) was used as an evaluation instrument (electrophotographic image forming apparatus). Apart from this, an image post-processing apparatus equipped with the glossiness control unit 100 illustrated in FIG. 4 was prepared.

As illustrated in FIG. 4, the glossiness control unit 100 includes the light irradiation unit 101 and the control unit 102. As the light source used for the light irradiation unit 101, an LED having a maximum emission wavelength of 365 nm (365 nm±20 nm) was used.

[Image Post-Processing Condition 1]

A toner image was fixed on a recording medium by using a developer 1 in the image forming apparatus "bizhub PRESS C1080" (manufactured by Konica Minolta, Inc.).

Figure 7:
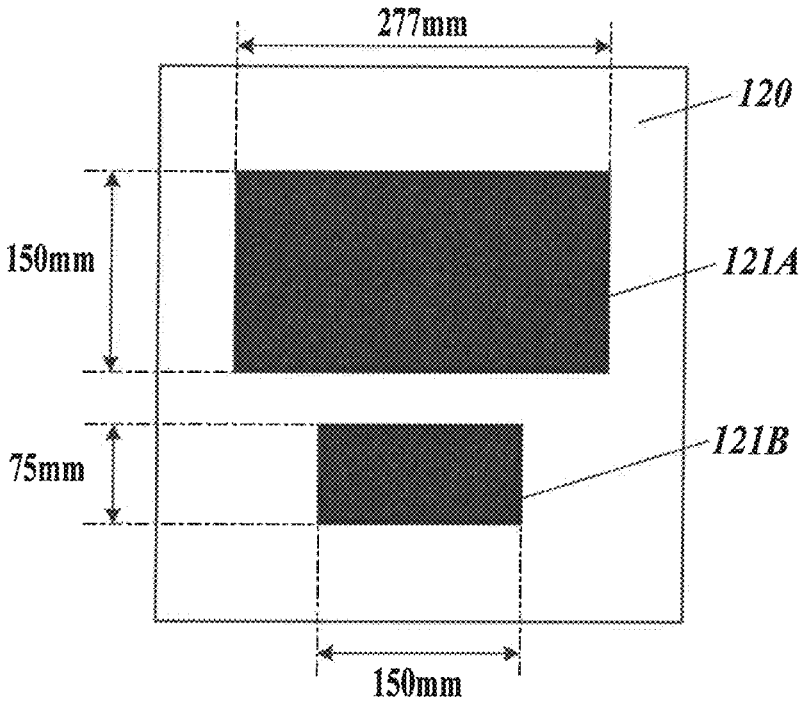
FIG. 7 is an explanatory diagram illustrating a toner image A and a toner image B fixed on a recording medium.

As illustrated in FIG. 7, an evaluation image was output on an A3 coated paper (basis weight: 128 g/m$^2$) which is the recording medium 120. This evaluation image contains the following images: a solid toner image A (a toner image 121A) having a size of 150 mm×277 mm (longitudinal direction x short-side direction, overlapping the short-side center line of the image and the middle line in the short-side direction) in a position at 105 mm from the upper end in the longitudinal direction; and a solid toner image B (a toner image 121B) having a size of 75 mm×155 mm (longitudinal direction x short-side direction, overlapping the short-side center line of the image and the middle line in the short-side direction) in a position at 315 mm from the upper end in the longitudinal direction. The evaluation image was post-processed by the image post-processing apparatus. Specifically, the recording medium was moved by the conveying unit, and the glossiness control light with the light amount of 2.0 J/cm$^2$ was irradiated to the toner image A, and the toner image B from the LED as the light irradiation unit.

[Image Post-Processing Conditions 2 to 14]

Image post-processing conditions 2 to 14 were the same as the image post-processing; condition 1, except that the toner used for forming the toner image was changed to the toner as described in Table I; the maximum emission wavelength of the light source used for the light was changed to the wavelength as described in Table 1; and the light amount was changed to the light amount (J/cm2) as described in Table I.

In the image post-processing condition 10, the glossiness control light with the light amount of 2.0 (J/cm2) was irradiated on the toner image A, and the glossiness control light was not irradiated on the toner image B.

In the image post-processing condition 11, the toner image A. was irradiated with the glossiness control light having a light amount of 4.5 (J/cm2), and the glossiness control light with the light amount of 2.0 (J/cm2) was irradiated on the toner image B.

In the image post-processing condition 12, the glossiness control light was not irradiated on the toner image A and the toner image B.

<Measurement of Glossiness>

For the toner image A and the toner image B after the image post-processing conditions, the glossiness (%) at an incident angle of 60° was measured for three points in total: one of them is an image center points; and the other two of them are points at every 50 mm from the center of the image with respect to the minor axis direction of the recording medium. The glossiness (%) was measured using a glossiness measuring instrument MULTI GROSS 268 Plus (manufactured by Konica Minolta, Inc.). Similarly, the initial glossiness of the toner image A and the toner image B before light irradiation was also measured. Further, the absolute value of the difference between the glossiness of the toner image before light irradiation and the glossiness of the toner image after light irradiation was calculated. A case where a difference in glossiness of 3% or more occurred was judged as acceptable, and a case where it was less than 3% was judged as unacceptable. The evaluation results are indicated in Table II.

TABLE I

| Image post-processing condition | Toner | | | Image post-processing condition | | | |
|---|---|---|---|---|---|---|---|
| | Toner | Compound that absorbs light | | Maximum emission wavelength (nm) | Wavelength region of irradiation light (nm) | Light amount (J/cm$^2$) | |
| | No. | Colorant | UV absorber | | | Toner image A | Toner image B |
| 1 | T1 | Black | — | 365 | 365 ± 20 | 2.0 | |
| 2 | T1 | Black | | 385 | 385 ± 10 | 2.2 | |
| 3 | T1 | Black | — | 405 | 405 ± 10 | 2.7 | |
| 4 | T1 | Black | — | 280 | 280 ± 10 | 1.6 | |
| 5 | T1 | Black | — | 480 | 480 ± 10 | 4.1 | |
| 6 | T1 | Black | — | 850 | 850 ± 10 | 4.9 | |
| 7 | T2 | Magenta | — | 365 | 365 ± 20 | 2.5 | |
| 8 | T3 | Black | Uvinul 3049 | 365 | 365 ± 20 | 1.0 | |
| 9 | T1 | Black | — | 365 | 365 ± 20 | 4.5 | |
| 10 | T1 | Black | — | 365 | 365 ± 20 | 2.0 | No irradiation |
| 11 | T1 | Black | — | 365 | 365 ± 20 | 4.5 | 2.0 |
| 12 | T1 | Black | — | No irradiation | No irradiation | No irradiation | |
| 13 | T1 | Black | — | 240 | 240 ± 10 | 2.0 | |
| 14 | T1 | Black | — | 950 | 950 ± 10 | 2.0 | |

TABLE II

| Image post-processing condition | Glossiness before image post-processing (%) | | Glossiness after image post-processing (%) | | Evaluations | | Remarks |
|---|---|---|---|---|---|---|---|
| | Toner image A | Toner image B | Toner image A | Toner image B | Toner image A | Toner image B | |
| 1 | 42 | | 26 | | Acceptable | | Present invention |
| 2 | 42 | | 27 | | Acceptable | | Present invention |
| 3 | 42 | | 29 | | Acceptable | | Present invention |
| 4 | 42 | | 25 | | Acceptable | | Present invention |
| 5 | 42 | | 32 | | Acceptable | | Present invention |
| 6 | 42 | | 34 | | Acceptable | | Present invention |
| 7 | 41 | | 30 | | Acceptable | | Present invention |
| 8 | 44 | | 25 | | Acceptable | | Present invention |
| 9 | 42 | | 53 | | Acceptable | | Present invention |
| 10 | 42 | 42 | 26 | 42 | Acceptable | — | Present invention |
| 11 | 42 | 42 | 53 | 26 | Acceptable | Acceptable | Present invention |
| 12 | 42 | | 42 | | — | | Comparative example |
| 13 | 42 | | *1 | | Unacceptable | | Comparative example |
| 14 | 42 | | 41 | | Unacceptable | | Comparative example |

*1: Since gloss uniformity was decreased, it was impossible to measure glossiness.

From the results listed in Table II, it was found that the glossiness of the toner image can be controlled by the image post-processing method containing a specific glossiness control step reducing or increasing the glossiness of the fixed toner image. This image post-processing contains a glossiness control step of: irradiating the fixed toner image formed with a toner containing a compound that absorbs light and fixed on a recording medium with a glossiness control light that is capable of at least reducing a glossiness of the fixed toner image, wherein the glossiness control light has a maximum emission wavelength in a wavelength region which is absorbed by the compound.

Further, in the image post-processing method of the present invention, the glossiness is not controlled by changing the fixing temperature as in the conventional image post-processing method, but the glossiness of the toner image can be controlled by simply irradiating the toner image with the predetermined glossiness control light. Therefore, in the image post-processing method of the present invention, it is possible to control the glossiness of the toner image without affecting the fixability of the toner image.

The graph illustrated in FIG. 5 may be obtained as follows. The glossiness control light is irradiated to a toner image fixed on a recording medium at a predetermined maximum emission wavelength with an arbitrary light amount, and the glossiness (%) to the irradiated light amount is plotted. By using this graph, it is possible to calculate the light amount corresponding to the glossiness that is designated by the user. Therefore, it is possible to irradiate the toner image with the glossiness control light to produce the specified glossiness.

In this image post-processing method, the glossiness of only the portion irradiated with the glossiness control light can be changed. Consequently, when only a specific position portion of the toner image is specified, only the glossiness of the portion can be lowered or increased.

What is claimed is:

1. An image post-processing method for controlling a glossiness of a fixed toner image, the method comprising a glossiness control step of:

irradiating the fixed toner image formed with a toner containing a compound that absorbs light and fixed on a recording medium with a glossiness control light that is configured to reduce a glossiness of the fixed toner image, wherein the glossiness control light has a maximum emission wavelength in a wavelength region which is absorbed by the compound, and the glossiness control light does not melt the toner.

2. The image post-processing method described in claim 1, wherein the method further comprises:

designating glossiness information by a user about the glossiness of the toner image; and controlling a light amount of the glossiness control light in the glossiness control step based on the glossiness information designated by the user.

3. The image post-processing method described in claim 2, wherein the light amount of the glossiness control light is controlled based on relational information on a change in the glossiness of the toner image with respect to the light amount of the glossiness control light to be irradiated.

4. The image post-processing method described in claim 1, wherein the glossiness control step comprises:

designating positional information by a user where glossiness is to be reduced on the toner image; and determining an irradiation position of the glossiness control light based on the positional information of the toner image designated by the user.

5. The image post-processing method described in claim 1, wherein, in the glossiness control step, the glossiness control light is irradiated to the toner images fixed on a plurality of portions on the recording medium.

6. The image post-processing method described in claim 1, wherein the glossiness control light has a maximum emission wavelength in a wavelength region of 280 nm to 850 nm.

7. The image post-processing method described in claim 1, wherein the glossiness control light has a maximum emission wavelength in a wavelength region of 280 nm to 500 nm.

8. The image post-processing method described in claim 1, wherein the compound that absorbs light is a colorant.

9. The image post-processing method described in claim 1, wherein the compound that absorbs light is a UV absorber.

10. The image post-processing method described in claim 1, wherein the method further contains a step of detecting the glossiness of the fixed toner image on the recording medium before conducting the glossiness control step.

11. An image post-processing apparatus comprising a glossiness control unit and a light source of a glossiness control light, wherein the glossiness control unit controls the glossiness control light to reduce a glossiness of a fixed toner image by irradiating the fixed toner image, the fixed toner image is formed with a toner containing a compound that absorbs light, the toner image is fixed on a recording medium, and the glossiness control light is configured to reduce the glossiness of the fixed toner image without melting the toner.

12. An image forming apparatus comprising:

a transfer unit to transfer a toner image formed on an electrophotographic photoreceptor with a toner containing a compound that absorbs light on a recording medium; and a fixing unit to fix the transferred toner image on the recording medium, wherein the image forming apparatus is connected to the image post-processing apparatus described in claim 11.

13. An image forming apparatus comprising:

a transfer unit to transfer a toner image formed on an electrophotographic photoreceptor with a toner containing a compound that absorbs light on a recording medium;

a fixing unit to fix the transferred toner image on the recording medium; and a glossiness control unit to reduce a glossiness of the fixed toner image by irradiating the fixed toner image formed on the recording medium with a glossiness control light having a maximum emission wavelength in a wavelength region which is absorbed by the compound and is configured to reduce the glossiness of the fixed toner image without melting the toner.

* * * * *